US005415148A

United States Patent [19]

Kanehiro et al.

[11] Patent Number: 5,415,148

[45] Date of Patent: May 16, 1995

[54] MISFIRE-DETECTING SYSTEM FOR INTERNAL COMBUSTION ENGINES

[75] Inventors: Masaki Kanehiro; Jiro Takagi; Yuichi Shimasaki; Shigeru Maruyama; Takashi Hisaki, all of Wako, Japan

[73] Assignee: Honda Giken Kogyo Kabushiki Kaisha, Tokyo, Japan

[21] Appl. No.: 176,445

[22] Filed: Jan. 3, 1994

[30] Foreign Application Priority Data

Jan. 13, 1993 [JP] Japan ..... 5-020496

[51] Int. Cl.[6] ..... F02P 11/00

[52] U.S. Cl. ..... 123/630

[58] Field of Search ..... 123/630, 641, 479, 481, 123/198 F; 324/399, 378, 380, 388, 399; 73/117.3

[56] References Cited

U.S. PATENT DOCUMENTS

| | | | |
|---|---|---|---|
| 3,942,102 | 3/1976 | Kuhn et al. | 324/399 |
| 3,961,240 | 6/1976 | Pohl | 324/399 |
| 4,757,798 | 7/1988 | Sasaki | 123/630 |
| 4,996,964 | 3/1991 | Ohuchi | 123/630 |
| 5,042,449 | 8/1991 | Dassetto | 123/641 |
| 5,215,067 | 6/1993 | Shimasaki et al. | 123/630 |

*Primary Examiner*—Raymond A. Nelli

*Attorney, Agent, or Firm*—Nikaido, Marmelstein, Murray & Oram

[57] ABSTRACT

A misfire-determining system for an internal combustion engine detects sparking voltage generated when ignition is sequentially performed for each of cylinders. Adjacent durations of sparking voltage detected for respective cylinders are separately compared with a predetermined reference value by respective different misfire-determining circuits to determine whether or not a misfire has occurred.

5 Claims, 7 Drawing Sheets

T1
T2
A
G
TG
t0
t1
t2
t3
t4
t5
t6
t7
t8
t9
t10
t11
t12
V
VCOMP
C
B
0
VT
VTREF
C'
B'

MISFIRE-DETECTING SYSTEM FOR INTERNAL COMBUSTION ENGINES

BACKGROUND OF THE INVENTION

1. Field of the Invention

This invention relates to a misfire-detecting system for an internal combustion engine, and more particularly to a misfire-detecting system adapted to detect a misfire attributable to the fuel supply system.

2. Prior Art

In an internal combustion engine having spark plugs, a misfire can occur, in which normal ignition does not take place at one or more of the spark plugs. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called misparking), i.e. normal spark discharge does not take place at the spark plug, for example, due to smoking or wetting of the spark plug with fuel, particularly adhesion of carbon in the fuel or unburnt fuel to the spark plug, or abnormality in the sparking voltage supply system.

The present assignee has already proposed a misfire-detecting system for detecting misfires attributable to the fuel supply system, which comprises sparking voltage detecting means which detects sparking voltage, i.e. voltage across electrodes of the spark plug, and misfire-determining means which determines that a misfire has occurred based on a detected value of the sparking voltage, e.g. when a time period over which the detected value of the sparking voltage exceeds a predetermined reference value (U.S. Pat. No. 5,215,067).

FIG. 1*a* shows a timing chart for explaining a method of misfire determination carried out by the proposed system, in which are shown changes in the sparking voltage V and a comparative level (the predetermined reference value) VCOMP occurring in an example of a misfire determination. As shown in FIG. 1*a*, when the sparking voltage V exceeds the comparative level VCOMP which is set depending on the sparking voltage, a comparative signal pulse P1 is at a high level. If this state in which the comparative signal pulse P1 is at the high level continues over a predetermined time period, it is determined that a misfire has occurred. Therefore, in the example shown in FIG. 1*a*, it is determined that a misfire occurred in the first sparking operation at a time point t1, and that normal firing has occurred in the following sparking operation at a time point t2.

However, if the above method of misfire determination is applied to an engine having a large number of cylinders or an engine adapted to operate at a very high engine speed, there arises the following problems:

Referring to FIG. 1*b*, in this example of misfire determination as well, at the first sparking operation (at a time point t1), it is determined that a misfire has occurred since a comparative pulse P2 has continued to be at a high level over a predetermined time period. However, in the case of the engine having a large number of cylinders or the engine operating at a very high engine speed, a repetition period of ignition becomes so short that sparking discharge can be performed for the following cylinder at a time point t2 before sparking voltage detected or charged for the present sparking operation has attenuated. In such a case, as indicated by Q1 in FIG. 1*b*, the sparking voltage V detected is increased or pushed up. Therefore, a duration of the high level of the comparative pulse P2 occurring for this sparking operation become longer than a corresponding one shown in FIG. 1*a*, which can lead to an erroneous determination of a misfire in spite of the fact that firing has been normally performed. In this respect, the proposed system has room for improvement.

SUMMARY OF THE INVENTION

It is the object of the invention to provide a misfire detecting system for an internal combustion engine which is capable of detecting a misfire with high accuracy even for an engine having a large number of cylinders or for an engine adapted to operate at high engine speed.

To attain the above object, the present invention provides a misfire-determining system for an internal combustion engine having a plurality of cylinders and a plurality of spark plugs provided for the plurality of cylinders, respectively, including engine operating parameter-detecting means for detecting operating parameters of the engine, ignition command signal-generating means for determining ignition timing for one of the plurality of spark plugs selected in a predetermined sequence, based on the detected operating parameters of the engine, and for generating an ignition command signal to be supplied to the selected one of the plurality of spark plugs at the ignition timing, at least two igniting means each associated with at least one of the plurality of spark plugs, for generating high voltage in response to the ignition command signal to cause electric discharge of the selected one of the plurality of spark plugs, and at least two sparking voltage-detecting means each associated with a corresponding one of the at least two igniting means, respectively, for detecting sparking voltage when the high voltage is generated by the corresponding one of the at least two igniting means.

The misfire-detecting system according to the invention characterized by comprising at least two misfire-determining means each having the function of performing comparison of a value of the sparking voltage detected after generation of the ignition command signal with a predetermined reference value and for determining whether a misfire has occurred based on a result of the comparison, the at least two misfire-determining means being connected to the at least two sparking voltage-detecting means, respectively, for being supplied with the detected sparking voltage therefrom such that adjacent durations of sparking voltage detected on different ones of the at least two igniting means according to the predetermined sequence are separately supplied to different ones of the at least two misfire-determining means.

Preferably, each of the plurality of misfire-determining means includes first comparing means for comparing the detected value of the sparking voltage with the predetermined reference value, measuring means for measuring a degree to which the detected value of the sparking voltage exceeds the first predetermined reference value, second comparing means for comparing the degree measured by the measuring means with a second predetermined reference value, and determines whether or not a misfire has occurred in the engine, based upon results of the comparison by the second comparing means.

More preferably, the degree to which the detected value of the sparking voltage exceeds the first predetermined reference value is a time period over which the detected value of the sparking voltage exceeds the first predetermined reference value.

Further preferably, the misfire-detecting system includes re-charging means for generating a re-charging command signal at a predetermined time after generation of the ignition command signal, and wherein the sparking voltage-generating means applies voltage having a level low enough not to cause discharging of the spark plug to thereby store an electric charge within the sparking voltage-generating means.

The above and other objects, features, and advantages of the invention will become more apparent from the following detailed description taken in conjunction with the accompanying drawings.

BRIEF DESCRIPTION OF THE DRAWINGS

FIG. 6*a* to FIG. 6*e* collectively form a timing chart which is useful in explaining the operation of the misfire-detecting system at normal firing, in which:

FIG. 6*a* shows an energization control signal (ignition command signal) A;

FIG. 6*b* shows a gating signal G;

FIG. 6*c* shows changes in a comparative level VCOMP at normal firing to be compared with sparking voltage V;

FIG. 6*d* shows an output from a first comparator in FIG. 3; and

FIG. 6*e* shows an output from a pulse duration-measuring circuit in FIG. 3;

FIG. 7*a* to FIG. 7*d* collectively form a timing chart which is useful in explaining the operation of the misfire-detecting system at a misfire, in which:

FIG. 7*a* shows changes in the comparative level VCOMP at a misfire;

FIG. 7*b* shows an output from the first comparator, which is obtained at the misfire;

FIG. 7*c* shows an output from the pulse duration-measuring circuit, which is obtained at the misfire; and FIG. 7*d* shows an output from a second comparator in FIG. 3, which is obtained at the misfire.

DETAILED DESCRIPTION

The invention will now be described in detail with reference to the drawings showing an embodiment thereof.

Figure 1A:
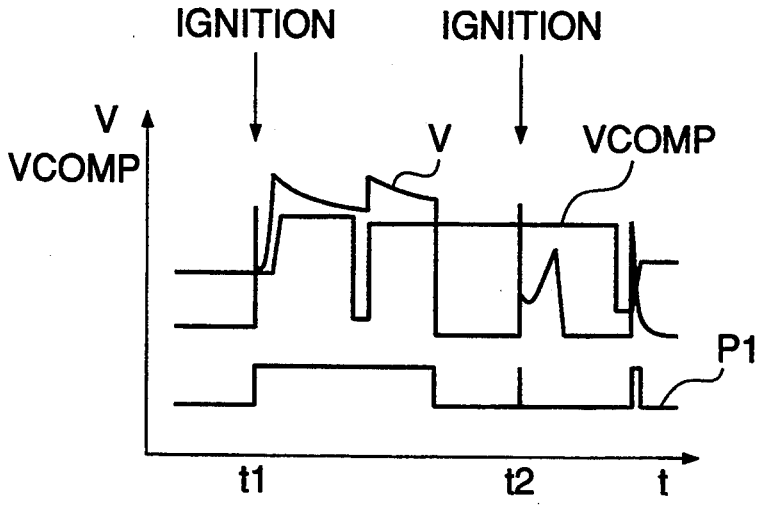
FIG. 1*a* is a timing chart which is useful in explaining a method of misfire determination carried out by the prior art.
Figure 1B:
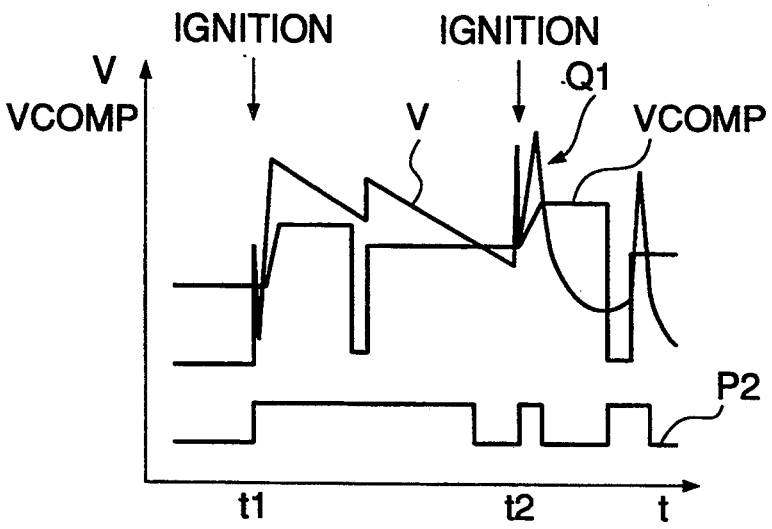
FIG. 1*b* is a timing chart for use in explaining inconveniences of the method of misfire determination carried out by the prior art.
Figure 2:
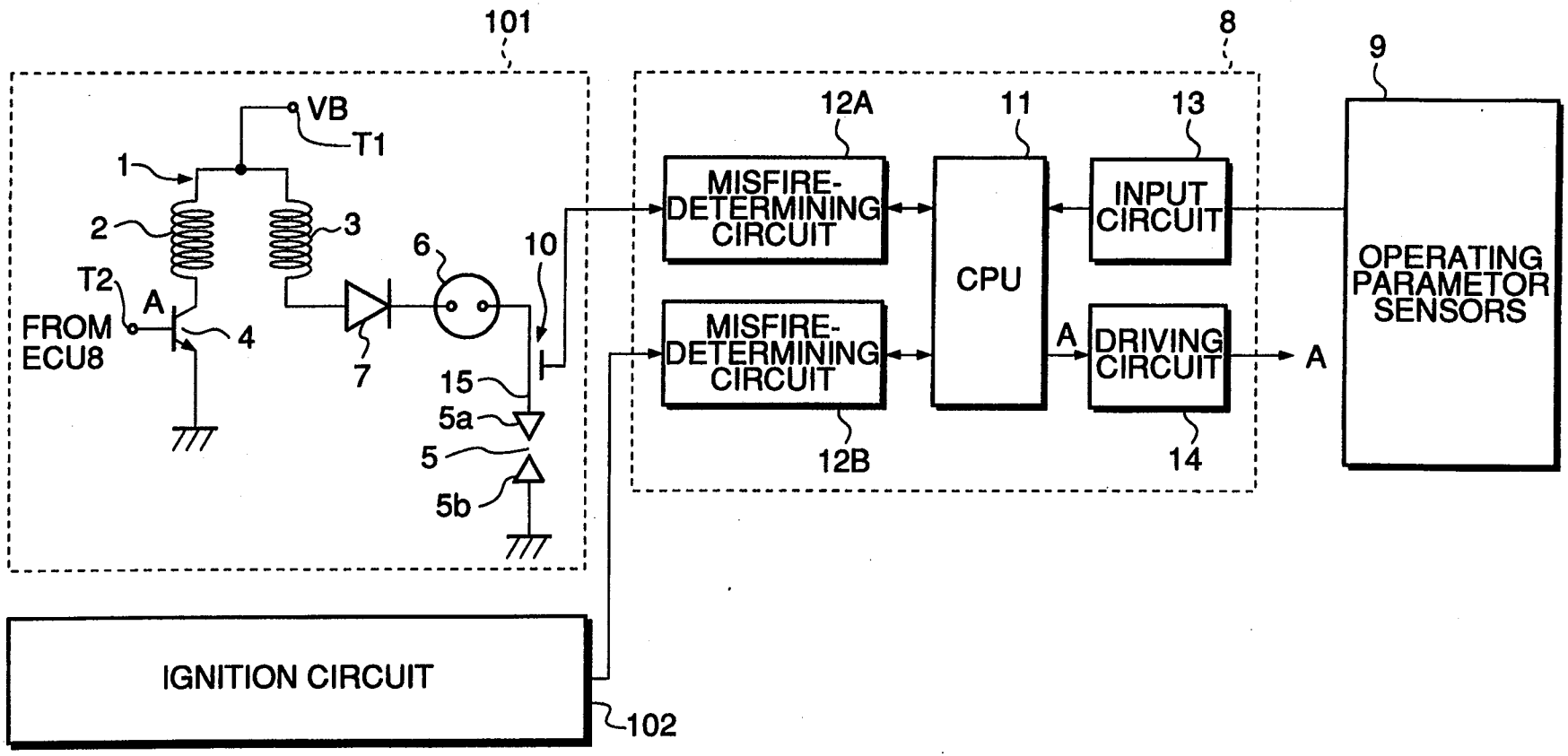
FIG. 2 is a block diagram showing the whole arrangement of a misfire-detecting system for an internal combustion engine according to an embodiment of the invention.

Referring first to FIG. 2, there is shown the arrangement of a misfire-detecting system according to a first embodiment of the invention. The internal combustion engine to which the present invention is applied has e.g. six cylinders for each of which is provided an ignition circuit for performing ignition. The ignition circuits for the cylinders have an identical circuit configuration, and sequentially controlled by an electronic control unit, described below, according to a firing order, such that each cylinder performs ignition e.g. in a sequence of a #1 cylinder, a #4 cylinder, a #2 cylinder, a #5 cylinder, a #3 cylinder, a #6 cylinder, a #1 cylinder . . .

For simplicity of explanation, in FIG. 2, an ignition circuit corresponding to a group of the #1 cylinder, #2 cylinder, and the #3 cylinder is designated as an ignition circuit 101, and similarly an ignition circuit corresponding to a group of the #4 cylinder, the #5 cylinder, and the #6 cylinder as an ignition circuit 102.

In FIG. 2, the ignition circuit 101 comprises a feeding terminal T1 which is supplied with supply voltage VB from a battery, not shown, an ignition coil 1 connected to the ignition terminal T1, which is comprised of a primary coil 2 and a secondary coil 3, the primary coil 2 and the secondary coil 3 being connected with each other at ends thereof, a transistor 4 having its collector connected to the other end of the primary coil 2, its base connected to an input terminal T2 through which is supplied an ignition command signal A, and its emitter grounded, a diode 7 having its anode connected to the other end of the secondary coil 3, a distributor 6 connected to the cathode of the diode 7, a spark plug 5 having its center electrode 5*a* connected via a connecting line 15 to the distributor 6 and its grounding electrode 5*b* grounded, and a sparking voltage sensor 10 provided at an intermediate portion of the connecting line 15, which is electrostatically coupled to the connecting line 15 and forms together therewith a capacitance of several pF's. The ignition circuit 102 is also similarly constructed.

As described hereinabove, the ignition circuit 101 corresponds to the group of the #1 cylinder, the #2 cylinder, and the #3 cylinder, and the distributor 6 distributes or selectively applies sparking voltage to selected one of the three spark plugs, only one of which is shown in FIG. 2, at ignition timing.

Further, when one ignition circuit is provided for each of the cylinders, the distributor 6 may be omitted.

Further, the sparking voltage sensor 10 may be provided between the diode 7 and the distributor 6.

The sparking voltage sensors 10 of the ignition circuits 101, 102 have their outputs connected to respective misfire-determining circuits 12A, 12B of the aforementioned electronic control circuit (hereinafter referred to as "the ECU") 8. The misfire-determining circuits 12A, 12B are connected to a central processing unit (hereinafter referred to as "the CPU") 11 to supply results of their misfire determinations thereto. The CPU 11 performs timing control related to the misfire determination. The above construction enables the misfire-determining circuits 12A, 12B to carry out separate misfire determination on different cylinders which are adjacent to each other in respect of the firing order.

Connected to the CPU 11 are various operating parameter sensors, generically designated by reference numeral 9, which sense various operating parameters of the engine including engine rotational speed NE and supply the sensed values of the operating parameters to the CPU 11 via an input circuit 13. The CPU 11 is connected to the base of the transistor 4 of each ignition circuit via a driving circuit 14 corresponding to each cylinder or corresponding to each group of cylinders, and determines ignition timing for each of the cylinders in a predetermined sequence based on the operating parameters of the engine to supply the ignition command signal A as an energization control signal to the transistor 4 based on the ignition timing thus determined.

Figure 3:
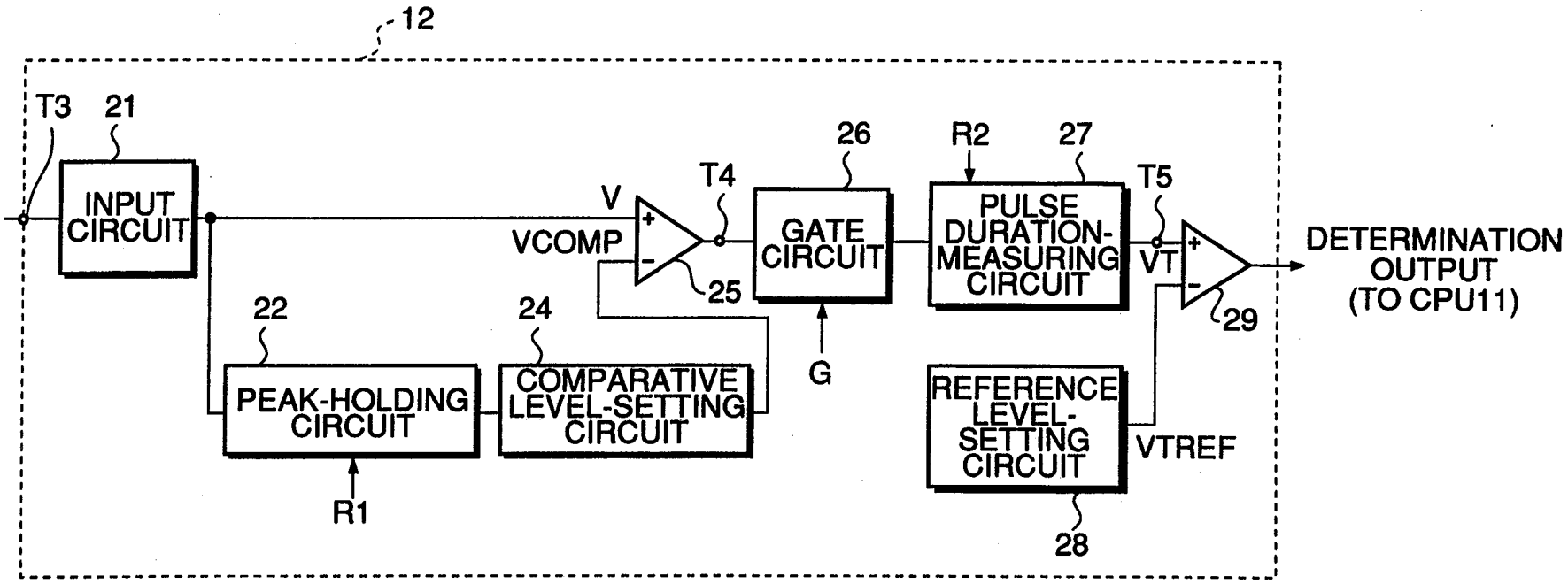
FIG. 3 is a circuit diagram showing details of a misfire-determining circuit appearing in FIG. 2.

FIG. 3 shows details of an identical circuit configuration of the misfire-determining circuits 12A, 12B. An input terminal T3 thereof is connected via an input circuit 21 to a non-inverting input terminal of a first comparator 25, as well as to an input of a peak-holding circuit 22. The output of the peak-holding circuit 22 is connected via a comparative level-setting circuit 24 to an inverting input terminal of the first comparator 25. The peak-holding circuit 22 is supplied with a resetting signal R1 from the CPU 11 for resetting at an appropriate time a peak value of the sparking voltage held by the peak-holding circuit 22.

An output from the first comparator 25 is supplied to a pulse duration-measuring circuit 27 via a gate circuit 26. The pulse duration-measuring circuit 27 measures a time duration during which an output from the first comparator 25 assumes a high level, within a gating time during which the gate circuit 26 permits an input thereto to be outputted as it is, and the circuit 27 supplies an output voltage VT corresponding to the measured time duration to a non-inverting input terminal of a second comparator 29. A reference level-setting circuit 28 is connected to an inverting input terminal of the second comparator 29 to supply the same with a reference voltage VTREF for misfire determination. When VT>VTREF stands, the second comparator 29 generates a high level output indicating that a misfire such as an FI misfire attributable to the fuel supply system of the engine has occurred. The reference voltage VTREF of the reference level-setting circuit 28 is varied in response to engine operating parameters. The CPU 11 also supplies the gate circuit 26 and the pulse duration-measuring circuit 27 with a gating signal G which determines the gating time and a resetting signal R2 which determines the timing of resetting the pulse duration-measuring circuit 27, respectively.

Figure 4:
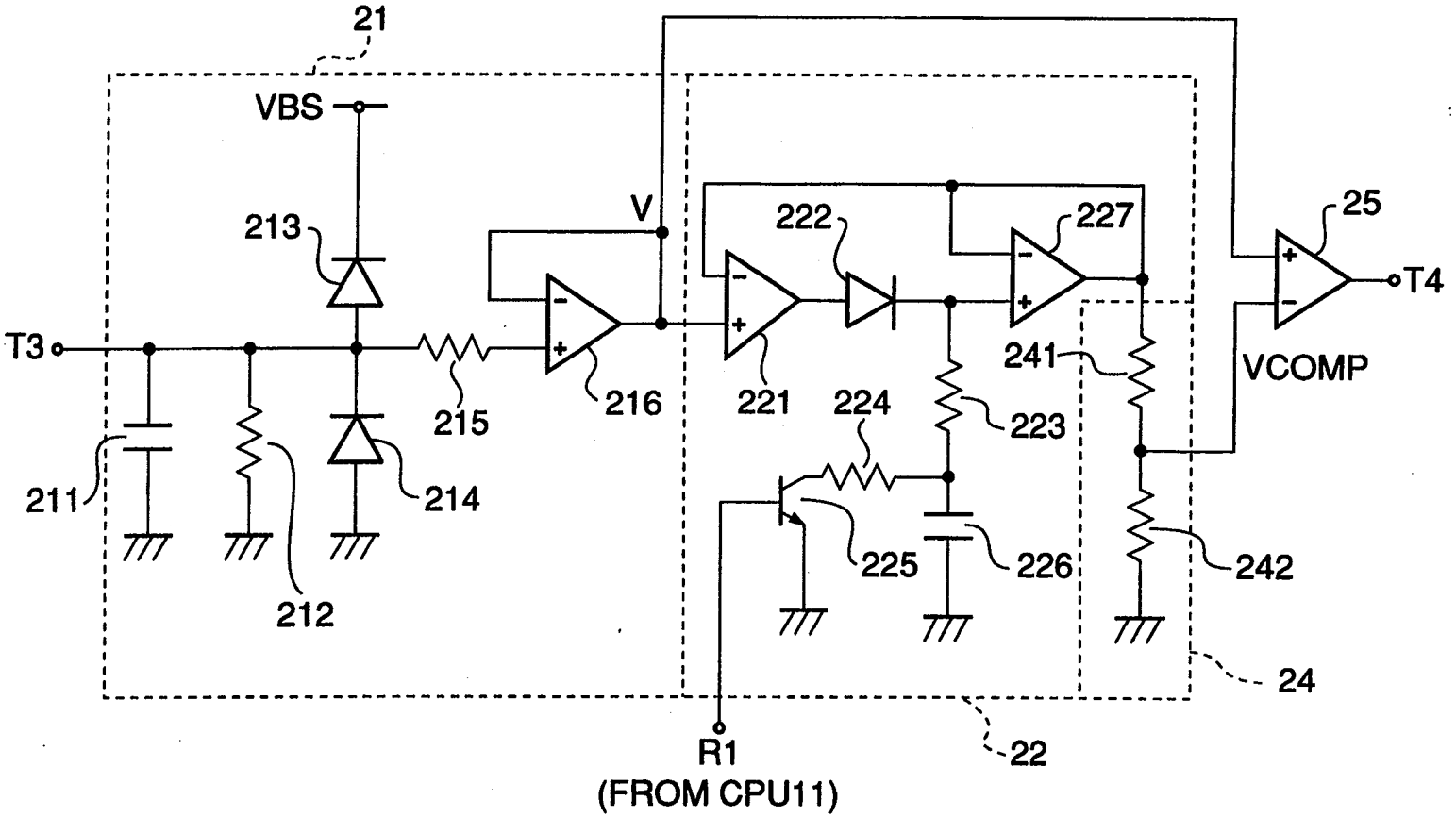
FIG. 4 is a circuit diagram showing details of parts of the misfire-determining circuit.

FIG. 4 shows details of the input circuit 21, the peak-holding circuit 22 and the comparative level-setting circuit 24 in FIG. 3. As shown in the figure, an input terminal T3 is connected to a non-inverting input terminal of an operational amplifier 216 via a resistance 215. The input terminal T3 is grounded via a circuit formed of a capacitor 211, a resistance 212, and a diode 214, which are connected in parallel, and connected to a supply voltage-feeding line VBS via a diode 213.

The capacitor 211 has a capacitance of $10^4$pF, for example, and serves to divide voltage detected by the sparking voltage sensor 13 into one over several thousands. The resistance 212 has a value of 500 KΩ, for example. The diodes 213 and 214 act to control the input voltage to the operational amplifier 216 to a range of 0 to VBS. An inverting input terminal of the operational amplifier 216 is connected to the output of the same so that the operational amplifier 216 operates as a buffer amplifier (impedance converter). The output of the operational amplifier 216 is connected to the non-inverting input terminal of the first comparator 25 as well as a non-inverting input terminal of an operational amplifier 221.

The output of the operational amplifier 221 is connected to a non-inverting input terminal of an operational amplifier 227 via a diode 222, with inverting input terminals of the amplifiers 221, 227 both connected to the output of the amplifier 227. Therefore, these operational amplifiers form a buffer amplifier.

The non-inverting input terminal of the operational amplifier 227 is grounded via a resistance 223 and a capacitor 226, the junction therebetween being connected to a collector of a transistor 225 via a resistance 224. The transistor 225 has its emitter grounded and its base supplied with the resetting signal R1 from the CPU 11. The resetting signal R1 goes high when resetting is to be made.

The output of the operational amplifier 227 is grounded via resistances 241 and 242 forming the comparative level-setting circuit 24, the junction between the resistances 241, 242 being connected to the inverting input terminal of the comparator 25.

The circuit of FIG. 4 operates as follows: A peak value of the detected sparking voltage V (output from the operational amplifier 216) is held by the peak-holding circuit 22, the held peak value is multiplied by a predetermined value smaller than 1 by the comparative level-setting circuit 24, and the resulting product is applied to the first comparator 25 as the comparative level VCOMP. Thus, a pulse signal indicative of the comparison result, which goes high when V>VCOMP stands, is outputted from the first comparator 25 through a terminal T4.

Figure 5:
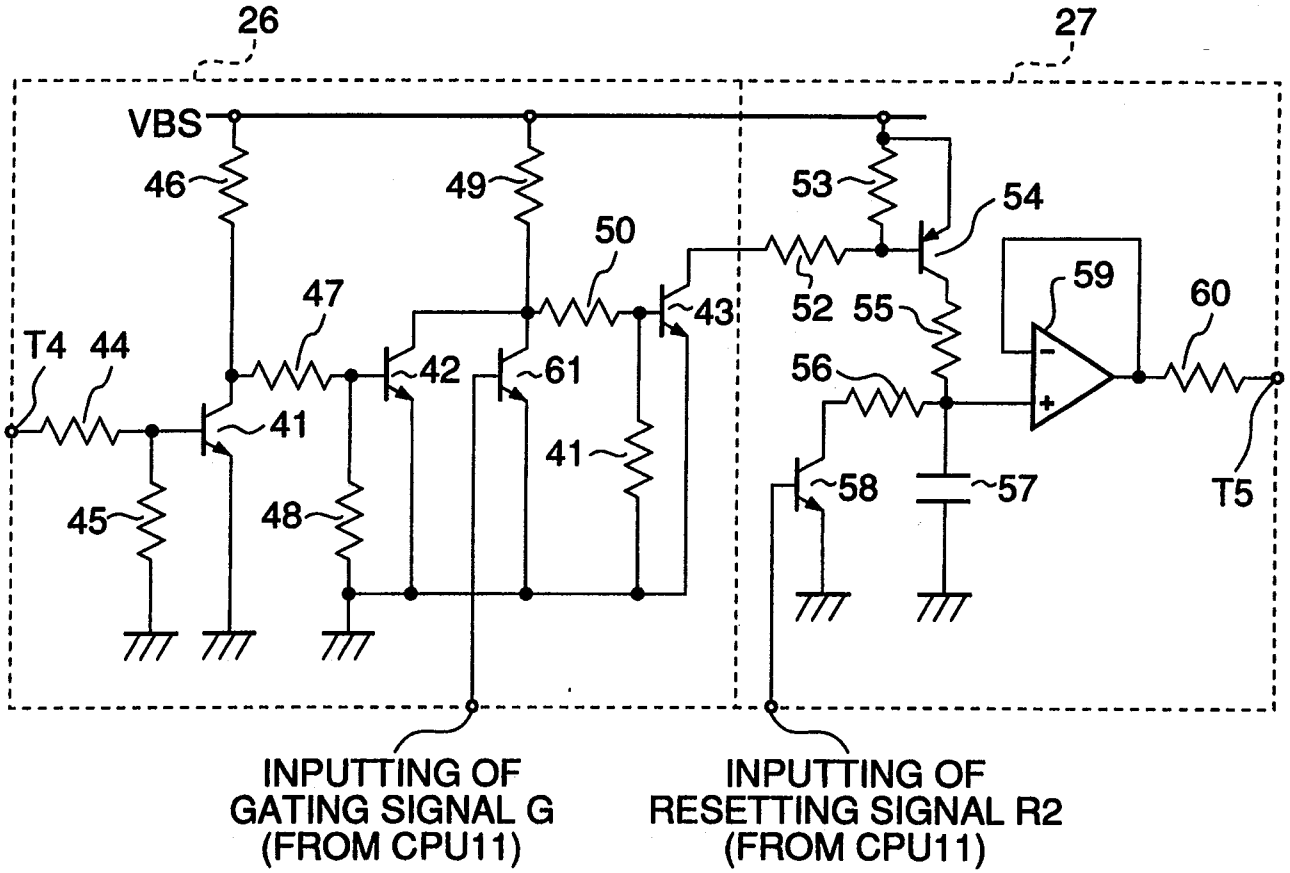
FIG. 5 is a circuit diagram showing details of other parts of the misfire-determining circuit.

FIG. 5 shows details of the construction of the gate circuit 26 and the pulse duration-measuring circuit 27. A three-stage invertor circuit is formed by transistors 41–43 and resistances 44–51. Connected between a collector of the transistor 42 and ground is a transistor 61 with a base thereof disposed to be supplied with the gating signal G from the CPU 11. Therefore, during the gating time during which the gating signal G assumes a low level, the collector of the transistor 43 goes low or high as the potential at 15 the terminal T4 goes high or low, whereas when the gating signal G assumes a high level, the collector of the transistor 43 remains at a high level irrespective of the potential at the terminal T4. The collector of the transistor 43 is connected to a base of a transistor 54 via a resistance 52, which has its base connected to the supply voltage-feeding line VBS via a resistance 53, its emitter directly connected to the line VBS, and its collector grounded via a resistance 55 and a capacitor 57. The junction between the resistance 55 and the capacitor 57 is connected to a terminal T5 via an operational amplifier 59 and a resistance 60. The operational amplifier 59 serves as a buffer amplifier. The junction between the resistance 55 and the capacitor 57 is connected via a resistance 56 to a collector of a transistor 58 which has its emitter grounded and its base disposed to be supplied with the resetting signal R2 from the CPU 11.

The circuit of FIG. 5 operates as follows: When the potential at the terminal T4 goes high while the gating signal G is at a low level, the potential at the collector of the transistor 43 goes low so that the transistor 54 turns on to cause charging of the capacitor 57. On the other hand, when the potential at the terminal T4 goes low or when the gating signal G goes high, the transistor turns off to stop charging of the capacitor 57. Therefore, the terminal T5 is supplied with a voltage VT having a value corresponding to the time period during which the pulse signal inputted through the terminal T4 assumes a high level.

Figures 6A, 6B, 6C, 6D, 6E, 7A, 7B, 7C, 7D:
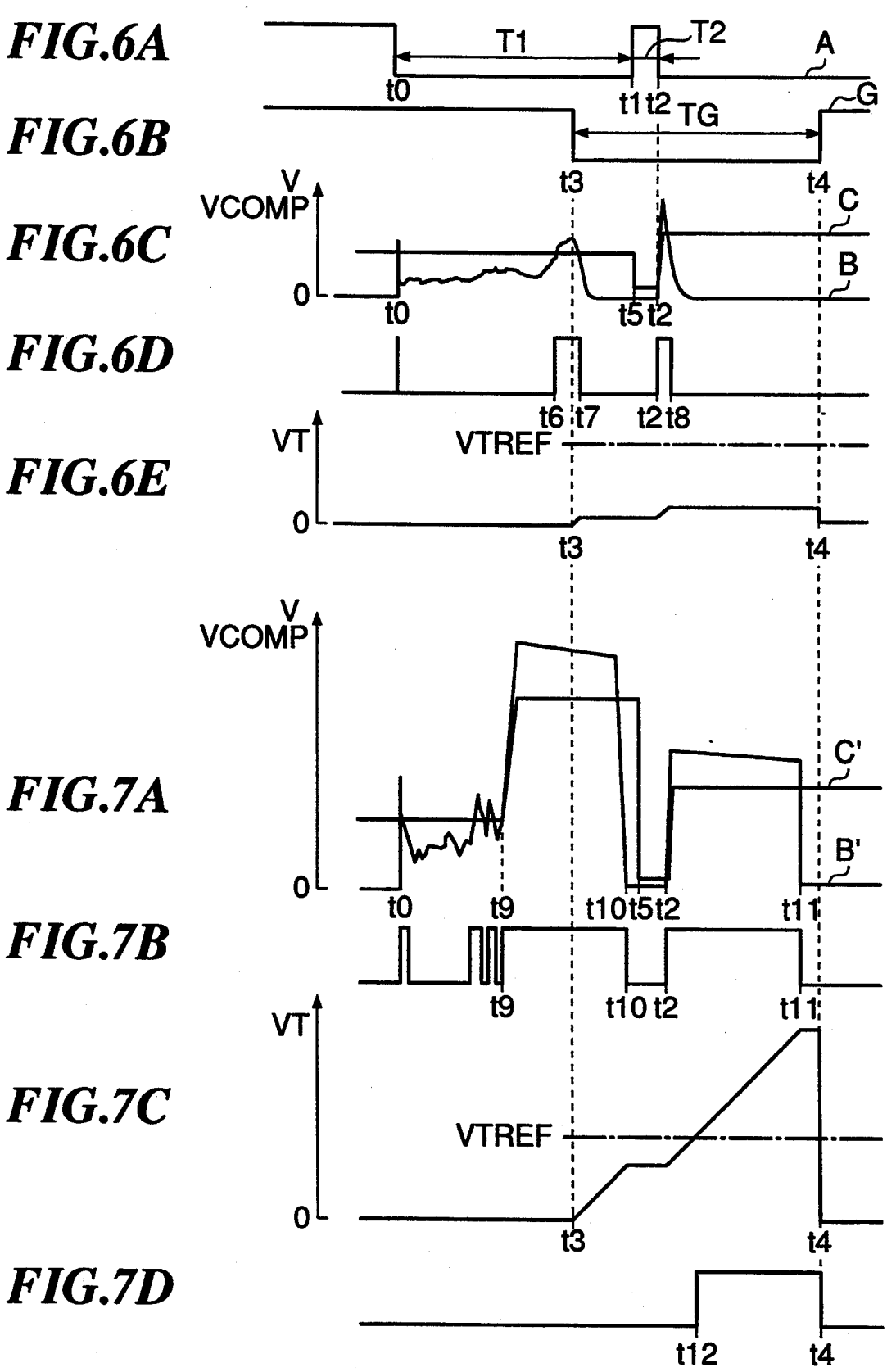

The operation of the misfire-detecting system constructed as above according to the present embodiment will now be explained with reference to a timing chart formed by FIG. 6*a* to FIG. 6*e* and one formed by FIG. 7*a* to FIG. 7*d*. FIGS. 6*a* and 6*b* show the energization control signal A and the gating signal G, respectively. FIG. 6*c* to FIG. 6*e* show operation at normal firing, while FIG. 7*a* to FIG. 7*d* show operation at a misfire attributable to the fuel supply system (hereinafter referred to as "FI misfire"). The misfire-determining operation, which is described below with reference to FIG. 6*a* to FIG. 7*d*, is performed on each cylinder in a similar manner.

As shown in FIG. 6*a*, according to the present embodiment, after the ignition command signal is generated at a time point t0, i.e. after the supply of current to the primary coil 2 is cut off after the coil 2 has been energized for a time period required for causing spark ignition, the coil 2 is again energized from a time point t1 to a time point t2 (hereinafter referred to as "reenergization"). This reenergization is carried out in such a manner that a voltage is applied between the electrodes of the spark plug 5 at the time point t2, which has such a low predetermined value as does not cause discharge between the electrodes, whereby electric charge is stored in floating capacitance between the spark plug 5 and its peripheral circuit parts. The voltage applied to the spark plug 5 at the time point t2 will be hereinafter referred to as the recharging voltage.

FIG. 6*c* and FIG. 7*a* show changes in the detected sparking voltage (output voltage from the input circuit 21) V (B, B') and changes in the comparative level VCOMP (C, C') with the lapse of time. First, a sparking voltage characteristic obtainable in the case of normal firing will be explained with reference to FIG. 6*c*.

Immediately after the time point t0 the ignition command signal A is generated, sparking voltage V rises to such a level as to cause dielectric breakdown of the mixture between the electrodes of the spark plug, i.e. across the discharging gap of the spark plug. After occurrence of the dielectric breakdown, the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge (lake-stage capacitive discharge) occurs. In this capacitive discharge state, the voltage between the spark plug electrodes again rises, i.e. in the direction of causing dielectric breakdown of the mixture. However, since the ignition coil 1 then has a small amount of residual energy, the amount of rise of the voltage is small. This is because the electrical resistance of the discharging gap is low due to ionizing of the mixture during firing.

In this connection, at normal firing, the charge stored in the floating capacitance between the diode 7 and the spark plug (i.e. residual charge left after the discharge) is not discharged toward the ignition coil 1 due to the presence of the diode 7, but neutralized by ions present in the vicinity of the electrodes of the spark plug 5, so that the sparking voltage V promptly declines after the termination of the capacitive discharge.

Thereafter, when the recharging voltage is applied to the spark plug at the time point t2, the sparking voltage V again rises. The electric charge charged in the floating capacitance by the application of the recharging voltage is neutralized by ions present in the vicinity of the electrodes of the spark plug 5 to promptly decline, similarly to the state immediately after termination of the late-stage capacitive discharge.

The comparative level VCOMP obtained from the peak held value of the sparking voltage V assumes, until a time point t5, a value corresponding to a peak-held value of sparking voltage V obtained after resetting of the peak-holding circuit 22 on the last occasion, in the illustrated example. When the peak-holding circuit 22 is reset at the time point t5 by the resetting signal R1, the comparative level VCOMP is held at a predetermined low level (>0 volts) until the time point t2, whereupon the predetermined low level or reset state is canceled (hereinafter, the timing of canceling the predetermined low level state will be referred to as "the resetting (initialization) timing"). Therefore, after the time point t2 the comparative level VCOMP shows a value dependent on a peak value of the sparking voltage V caused by the recharging voltage after the peak-holding circuit 22 was reset at the time point t5. In the present embodiment, the comparative level VCOMP is set to approximately two thirds of the peak value. As a result, the output from the first comparator 25 which compares between the sparking voltage V and the comparative level VCOMP assumes a high level at or about the time point t0, between time points t6 and t7, and between time points t2 and t8, as shown in FIG. 6*d*, whereas the output from the gate circuit 26 assumes a high level only between time points t3 and t7 and between time points t2 and t8, within the gating time TG during which the gating signal G is at a low level. Accordingly, the output VT from the pulse duration-measuring circuit 27 changes as shown in FIG. 6*e*, that is, it does not exceed the reference voltage VTREF, so that it is determined that the engine is in a normal firing state.

Next, a sparking voltage characteristic will be described, which is obtained when an FI misfire occurs, i.e. no firing occurs, due to supply of a lean mixture to the engine or cutting-off of the fuel supply to the engine caused by faulty operation of the fuel supply system, etc. In FIG. 7*a*, immediately after the time point t0 of generation of the ignition command signal A, the sparking voltage V (B') rises above a level causing dielectric breakdown of the mixture. In this case, the ratio of air in the mixture is greater than when the mixture supplied to the engine has an air-fuel ratio close to the stoichiometric ratio, and accordingly the dielectric strength of the mixture is high. Besides, since the mixture is not fired, it is not ionized so that the electrical resistance of the discharging gap of the spark plug is high. Consequently, the dielectric breakdown voltage becomes higher than that obtained in the case of normal firing of the mixture. Thereafter, the discharge state shifts to an inductive discharge state, as in the case of normal firing. However, the electrical resistance of the discharging gap of the spark plug at the discharge is greater in the case of supply of a lean mixture, etc. than that in the case of normal firing so that the inductive discharge state tends to shift to a capacitive discharge state earlier than in the case of normal firing. The capacitive discharge occurring after termination of the inductive discharge (late-stage capacitive discharge) is much higher than that at normal firing, because the voltage of dielectric breakdown of the mixture is higher than that at normal firing.

On this occasion, almost no ion is present in the vicinity of the electrodes of the spark plug 5 so that the charge stored between the diode 7 and the spark plug 5 is not neutralized, nor is it allowed to flow backward to the ignition coil 1 due to the presence of the diode 7. Therefore, the charge is held as it is without being discharged through the electrodes of the spark plug 5. Then, when the pressure within the engine cylinder lowers so that the voltage between the electrodes of the spark plug 5 required for discharge to occur becomes equal to the voltage applied by the charge, there occurs a discharge between the electrodes of the spark plug 5. As the sparking voltage V is higher, the discharge takes place earlier.

Thereafter, at the time point t2, the recharging voltage is applied to the spark plug 5. As a result, the sparking voltage V again rises. On this occasion, as mentioned above, there is almost no ion present between the electrodes of the spark plug and hence the charge stored between the diode 7 and the spark plug 5 is not neutralized, so that the sparking voltage V is held in a high voltage state due to the presence of the diode 7. As the pressure within the cylinder further lowers so that the voltage between the electrodes of the spark plug 5 required for discharge to occur becomes equal to the voltage applied by the charge, there occurs a discharge between the electrodes of the spark plug 5 (at a time point t11).

On the other hand, the comparative level VCOMP (C') assumes, until a time point t9, a value corresponding to a peak-held value of sparking voltage V obtained after resetting of the peak-holding circuit 22 on the last occasion, in the illustrated example. After the time point t9, the comparative level VCOMP rises with a rise in the sparking voltage V and thereafter is maintained at a value dependent upon a peak value of the sparking voltage V until the time point t5. When the peak-holding circuit 22 is reset at the time point t5 by the resetting signal R1, the comparative level VCOMP is held at a predetermined low level (>0 volts) until the time point t2. After the time point t2 the comparative level VCOMP is maintained at a value dependent on a peak value of the sparking voltage V caused by the application of the recharging voltage. As a result, the output from the first comparator 25 assumes a high level in the vicinity of the time point t0, shortly before the time point t9, between the time points t9 and t10, and between the time point t2 to the time point t11, as shown in FIG. 7*b*, whereas the output from the gate circuit 26 assumes a high level only during time periods when the output from the first comparator 25 assumes a high level within the gating time TG. Accordingly, the output VT from the pulse duration-measuring circuit 27 changes as shown in FIG. 7*c*, that is, it exceeds the reference voltage VTREF at a time point t12, so that the output from the second comparator 29 assumes a high level between time points t12 and t4 as shown in FIG. 7*d*, resulting in a determination that an FI misfire has occurred.

Further, in the present embodiment, the gating time period TG (the time point t3 to the time point t4) during which the gate circuit 26 is open, i.e. the gate circuit 26 allows its input signal to pass therethrough, is started from a time corresponding to the termination of the late-stage capacitive discharge. However, the time point t4 at which the gating time period TG terminates may be set to any time point before the rotor head of the distributor 6 passes the following segment (before the rotation of the crank angle goes through 120 degrees from the time point of firing).

The pulse duration-measuring circuit 27 is reset at the time point t4.

Figure 8:
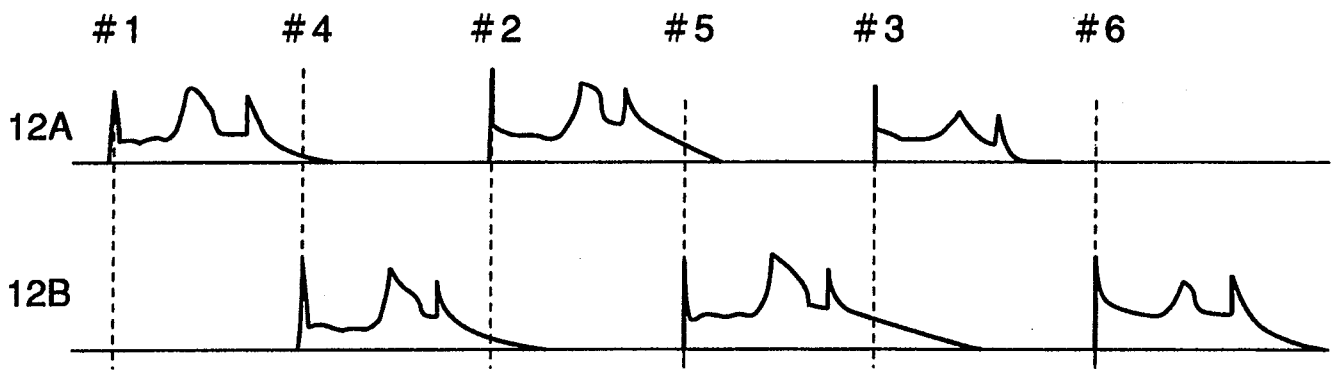
FIG. 8 is a diagram showing waveforms of sparking voltages input to misfire-determining circuits 12A, and 12B appearing in FIG. 2.

FIG. 8 shows an example of changes in sparking voltages input to the misfire-determining circuits 12A and 12B. As already described hereinabove, the sparking voltage detected by each sparking voltage sensor 10 is supplied alternately to the misfire-determining circuits 12A and 12B in such a sequence of sparking voltage from the #1 cylinder to 12A, that from the #4 cylinder to 12B, that from the #2 cylinder to 12A, that from the #5 cylinder to 12B, that from the #3 cylinder to 12A, that from the #6 cylinder to 12B.

In the example shown in FIG. 8, spark discharge for the #3 cylinder starts before the sparking voltage detected with the #5 cylinder has not attenuated. In the present embodiment, the misfire determination on the #5 cylinder is performed by the misfire-determining circuit 12B and that on the #3 cylinder is performed by the misfire-determining circuit 12A, independently of each other, which makes it possible to avoid overlapping of detected sparking voltages due to close ignition timing for cylinders to thereby perform misfire determination in an accurate and reliable manner.

Further, it is to be understood that the present invention is not limited to the embodiment described above only by way of example, but various modifications and variations can be made thereto. For example, there can be a variation in which the present invention is applied to an engine of a high engine speed type, although the present embodiment is adapted to the engine having a large number of cylinders. Further, if influence of residual sparking voltage detected on the preceding cylinder still adversely affects the misfire determination on the present cylinder, the cylinders may be divided into three groups each consisting of a cylinder and the next but two in the firing order, e.g. a group of the #1 cylinder and the #5 cylinder, one of the #4 cylinder and the #3 cylinder, and one of the #2 cylinder and the #6 cylinder, and three misfire-determining circuits may be provided for the groups, respectively. If this cannot shut out the influence of residual sparking voltage detected on a preceding cylinder, one misfire-determining circuit may be provided for each of the cylinders.

What is claimed is:

1. In a misfire-determining system for an internal combustion engine having a plurality of cylinders and a plurality of spark plugs provided for said plurality of cylinders, respectively, including engine operating parameter-detecting means for detecting operating parameters of said engine, ignition command signal-generating means for determining ignition timing for one of said plurality of spark plugs selected in a predetermined sequence, based on the detected operating parameters of said engine, and for generating an ignition command signal to be supplied to the selected one of said plurality of spark plugs at said ignition timing, at least two igniting means each associated with at least one of said plurality of spark plugs, for generating high voltage in response to said ignition command signal to cause electric discharge of said selected one of said plurality of spark plugs, and at least two sparking voltage-detecting means each associated with a corresponding one of said at least two igniting means, respectively, for detecting sparking voltage when said high voltage is generated by said corresponding one of said at least two igniting means, the improvement comprising at least two misfire-determining means each having the function of performing comparison of a value of said sparking voltage detected after generation of said ignition command signal with a predetermined reference value and for determining whether a misfire has occurred based on a result of said comparison, said at least two misfire-determining means being connected to said at least two sparking voltage-detecting means, respectively, for being supplied with the detected sparking voltage therefrom such that adjacent durations of sparking voltage detected on different ones of said at least two igniting means according to said predetermined sequence are separately supplied to different ones of said at least two misfire-determining means.

2. A misfire-detecting system according to claim 1, wherein each of said plurality of misfire-determining means includes first comparing means for comparing the detected value of said sparking voltage with said predetermined reference value, measuring means for measuring a degree to which the detected value of said sparking voltage exceeds said first predetermined reference value, second comparing means for comparing said degree measured by said measuring means with a second predetermined reference value, and determines whether or not a misfire has occurred in said engine, based upon results of said comparison by said second comparing means.

3. A misfire-detecting system according to claim 2, wherein said degree to which the detected value of said sparking voltage exceeds said first predetermined reference value is a time period over which the detected value of said sparking voltage exceeds said first predetermined reference value.

4. A misfire-detecting system according to claim 2, including re-charging means for generating a re-charging command signal at a predetermined time after generation of said ignition command signal, and wherein said sparking voltage-generating means applies voltage having a level low enough not to cause discharging of said spark plug to thereby store an electric charge within said sparking voltage-generating means.

5. A misfire-detecting system according to claim 3, including re-charging means for generating a re-charging command signal at a predetermined time after generation of said ignition command signal, and wherein said sparking voltage-generating means applies voltage having a level low enough not to cause discharging of said spark plug to thereby store an electric charge within said sparking voltage-generating means.

* * * * *